US007154443B2

(12) United States Patent
Inaba et al.

(10) Patent No.: US 7,154,443 B2
(45) Date of Patent: Dec. 26, 2006

(54) ANTENNA APPARATUS CAPABLE OF ACHIEVING A LOW-PROFILE DESIGN

(75) Inventors: Toshihiko Inaba, Akita (JP); Junichi Noro, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 11/068,681

(22) Filed: Feb. 28, 2005

(65) Prior Publication Data

US 2006/0044194 A1 Mar. 2, 2006

(30) Foreign Application Priority Data

Sep. 2, 2004 (JP) ..... 2004-255182

(51) Int. Cl.
*H01Q 1/24* (2006.01)

(52) U.S. Cl. ..... 343/702; 343/700 MS; 343/846; 343/895

(58) Field of Classification Search ..... 343/702, 343/700 MS
See application file for complete search history.

(56) References Cited

U.S. PATENT DOCUMENTS 5,966,097 A * 10/1999 Fukasawa et al. ... 343/700 MS
6,218,992 B1 * 4/2001 Sadler et al. ..... 343/702
6,326,921 B1 * 12/2001 Egorov et al. ..... 343/700 MS
6,738,023 B1 * 5/2004 Scott et al. ..... 343/700 MS
6,977,616 B1 * 12/2005 Yuanzhu ..... 343/700 MS
6,995,714 B1 * 2/2006 Sim et al. ..... 343/702
2004/0108957 A1 * 6/2004 Umehara et al. .... 343/700 MS
2006/0001575 A1 * 1/2006 Jo et al. ..... 343/702

FOREIGN PATENT DOCUMENTS

JP 8-78943 A 3/1996
JP 8-250925 A 9/1996

* cited by examiner

*Primary Examiner*—Don Wong
*Assistant Examiner*—Binh Van Ho
(74) *Attorney, Agent, or Firm*—Frishauf, Holtz, Goodman & Chick, P.C.

(57) ABSTRACT

An antenna apparatus according to the invention comprises an inverse F-element provided on a grounding conductor. The inverse F-element is constituted by an L-shaped radiating conductor and a short-circuiting conductor. The radiating conductor is constituted by a vertical portion vertically extending from a feeding point provided maintaining a gap with respect to the grounding conductor, and a horizontal portion extending in parallel with the grounding conductor from an upper end of the vertical portion. The vertical portion of the radiating conductor is of a meandering shape.

6 Claims, 4 Drawing Sheets

ANTENNA APPARATUS CAPABLE OF ACHIEVING A LOW-PROFILE DESIGN

This application claims priority to prior Japanese patent application JP 2004-255182, the disclosure of which is incorporated herein by reference.

BACKGROUND OF THE INVENTION

This invention relates to an antenna apparatus used for mobile communication equipment and, particularly, to a wide-band antenna apparatus having a wide frequency band, such as an on-vehicle cellular antenna apparatus.

A wide-band antenna apparatus of this kind is one having, for example, a transmission/reception frequency band of 824 MHz to 894 MHz, and a frequency band width of 70 MHz. An on-vehicle cellular antenna apparatus is mounted inside the vehicle, such as inside the dashboard or inside the vehicle body. Therefore, the on-vehicle cellular antenna apparatus must be one of the type of a low profile or of a planar type instead of the antenna apparatus of the pole type which is generally used.

As the antenna apparatus of the low profile type, there has been widely known an antenna apparatus called inverse F-type antenna apparatus (for example, Japanese Unexamined Patent Application Publications Nos. JP-A-8-78943 and JP-A-8-250925).

A conventional inverse F-type antenna apparatus 10 will now be described with reference to FIGS. 1 to 4. FIGS. 1 and 2 are a perspective view and a plan view of the inverse F-type antenna apparatus 10, and FIGS. 3 and 4 are a front view and a right side view of the inverse F-type antenna apparatus 10.

The inverse F-type antenna apparatus 10 includes a grounding conductor 12, an L-shaped radiating conductor 14, and a vertical conductor 16.

In detail, the grounding conductor 12 is of a square shape having a side of a length $W_G$. In the illustrated embodiment, the grounding conductor 12 has a length $W_G$ of 90 mm. The radiating conductor 14 includes a vertical portion 141 extending vertically from a feeding point 18 provided maintaining a very narrow gap to the grounding conductor 12, and a horizontal portion 142 extending in parallel with the grounding conductor 12 from an end (upper end) of the vertical portion 141. The vertical portion 141 has an inverse isosceles triangular shape with the feeding point 18 as a vertex. The sides of the inverse isosceles triangle opposing the vertex are forming the end (upper end) of the vertical portion 141. The horizontal portion 142 is of a rectangular shape having a length $L_L$ and a width $W_L$. In the illustrated embodiment, the horizontal portion 142 has a length $L_L$ of 69.75 mm and a width $W_L$ of 30 mm. An end of the horizontal portion 142 is connected to the end (upper end) of the vertical portion 141, and the other end of the horizontal portion 142 is opened. The length from the feeding point 18 of the radiating conductor 14 to the open end is selected to possess an electric length of about one-fourth the radiation wavelength.

The vertical conductor 16 has a rectangular shape and is located at a position slightly separated from the vertical portion 141. The vertical conductor 16 is vertically extending in parallel with the vertical portion 141 of the radiating conductor 14 from the grounding conductor 12 to the horizontal portion 142. That is, one end of the vertical conductor 16 is connected to the grounding conductor 12, and the other end of the vertical conductor 16 is connected to the horizontal portion 142 of the radiating conductor 14.

The vertical conductor 16 is also called short-circuiting conductor. In the illustrated embodiment, the vertical conductor 16 has a height $H_L$ of 34 mm. The height $H_L$ of the vertical conductor 16 is nearly equal to the height of the inverse F-type antenna apparatus 10.

A coaxial cable 20 is connected to the inverse F-type antenna apparatus 10. As is well known, the coaxial cable 20 has a center conductor and an outer conductor. The center conductor of the coaxial cable 20 is electrically connected to the feeding point 18, and the outer conductor of the coaxial cable 20 is electrically connected to the grounding conductor 12.

A combination of the L-shaped radiating conductor 14 and the vertical conductor 16 is called an inverse F-element. As shown in FIGS. 1 and 2, the inverse F-element is provided at an end of the grounding conductor 12 instead of at the center of the grounding conductor 12. This is because, if the inverse F-element is brought to an end of the grounding conductor 12, the current profile varies due to the interaction between the grounding conductor and the inverse F-element, and the impedance matching can be easily selected.

The above-mentioned inverse F-type antenna apparatus 10 can be realized in a low profile. However, it has been desired to further decrease the height yet maintaining the antenna characteristics such as the radiation pattern characteristic.

SUMMARY OF THE INVENTION

It is therefore an object of this invention to provide an antenna apparatus capable of achieving a further lowered profile yet maintaining antenna characteristics.

An antenna apparatus according to this invention comprises a grounding conductor and an inverse F-element provided on the grounding conductor. The inverse F-element is constituted by an L-shaped radiating conductor and a short-circuiting conductor. The radiating conductor is constituted by a vertical portion vertically extending from a feeding point provided maintaining a gap with respect to the grounding conductor, and a horizontal portion extending in parallel with the grounding conductor from an upper end of the vertical portion. The short-circuiting conductor is vertically extending from the grounding conductor to the horizontal portion of the radiating conductor in parallel with the vertical portion of the radiating conductor at a position separated from the vertical portion. The vertical portion of the radiating conductor is of a meandering shape.

In the antenna apparatus according to this invention, it is preferable that the vertical portion of the radiating conductor includes a lower portion upwardly extending from the feeding point, an upper portion downwardly extending from the upper end, and an intermediate portion folded between the lower portion and the upper portion.

In the antenna apparatus according to this invention, it is preferable that the intermediate portion has a shape dented toward the side of the short-circuiting conductor or toward the side opposite to the short-circuiting conductor.

In the antenna apparatus according to this invention, it is preferable that the vertical portion of the radiating conductor has an inverse isosceles triangular shape with the feeding point as a vertex, and that the horizontal portion of the radiating conductor has a rectangular shape.

DESCRIPTION OF THE PREFERRED EMBODIMENT

Figure 5:
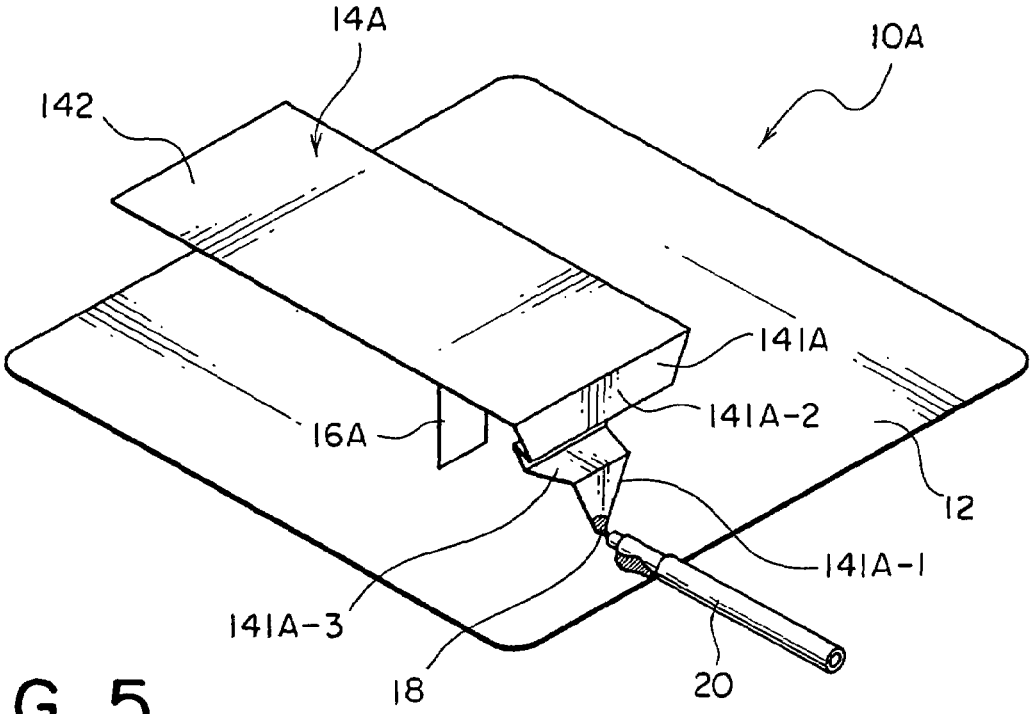
FIG. 5 is a perspective view of an antenna apparatus according to an embodiment of the invention.
Figure 6:
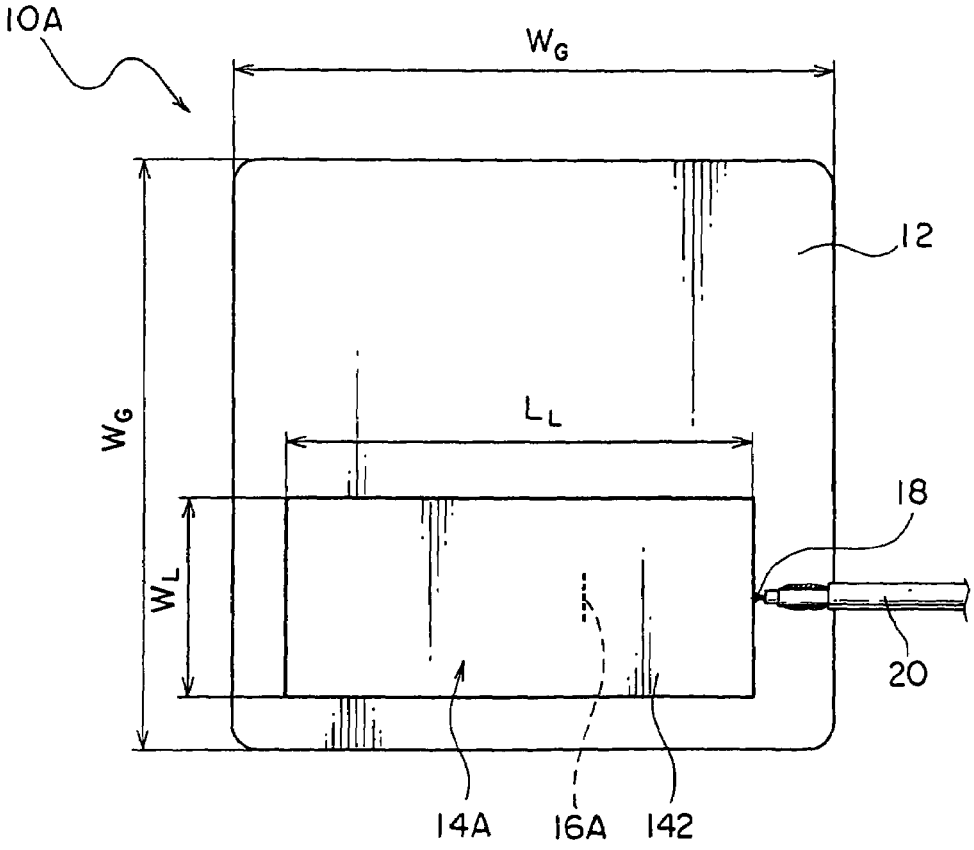
FIG. 6 is a plan view of the antenna apparatus illustrated in FIG. 5.
Figure 7:
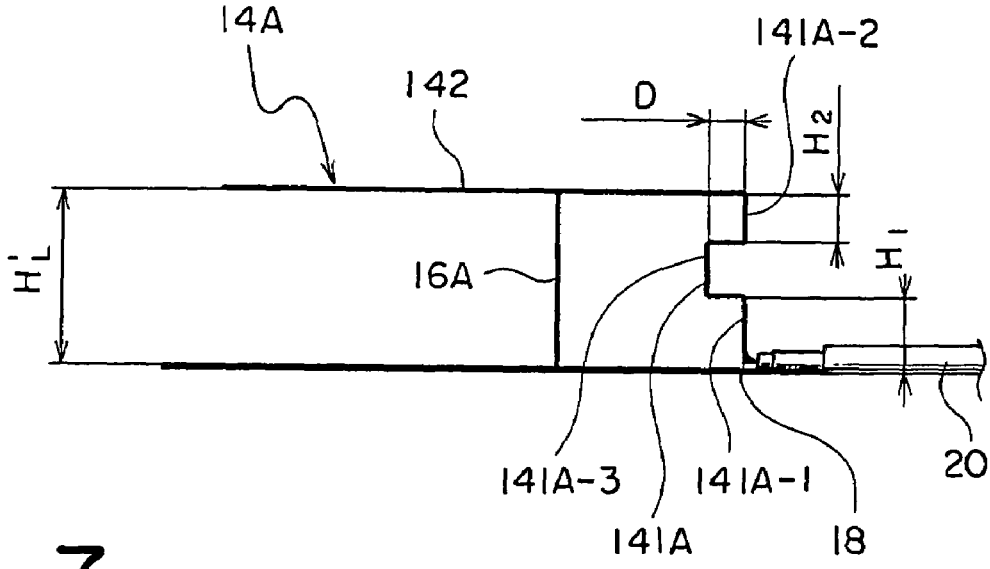
FIG. 7 is a front view of the antenna apparatus illustrated in FIG. 5.
Figure 8:
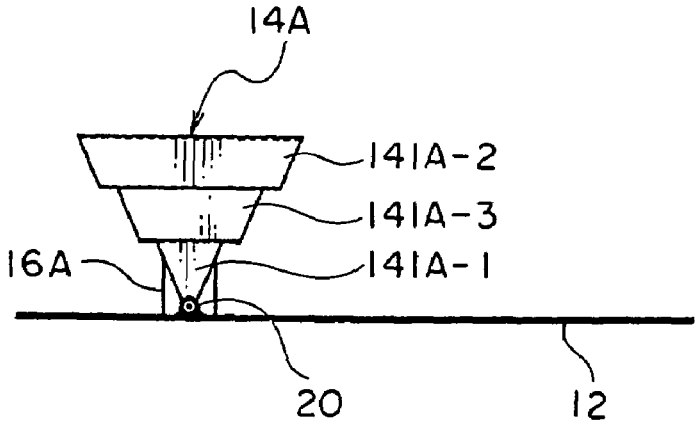
FIG. 8 is a right side view of the antenna apparatus illustrated in FIG. 5.

An inverse F-type antenna apparatus 10A according to an embodiment of this invention will now be described with reference to FIGS. 5 to 8. FIGS. 5 and 6 are a perspective view and a plan view of the inverse F-type antenna apparatus 10A, and FIGS. 7 and 8 are a front view and a right side view of the inverse F-type antenna apparatus 10A.

Figure 1:
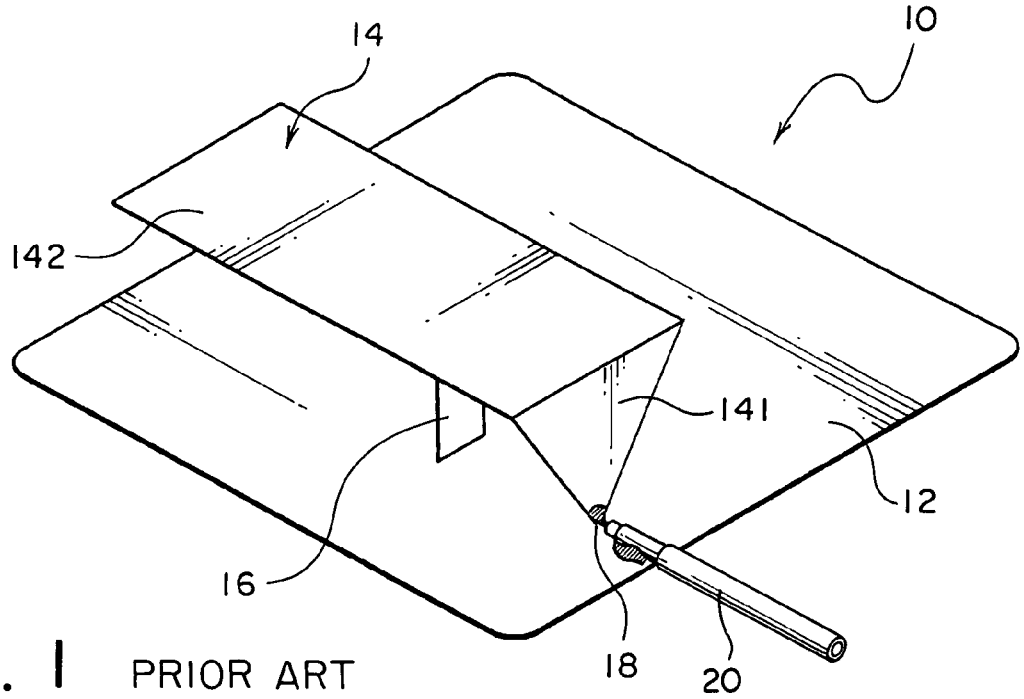
FIG. 1 PRIOR ART
FIG. 1 is a perspective view of a conventional antenna apparatus called inverse F-type antenna apparatus.
Figure 2:
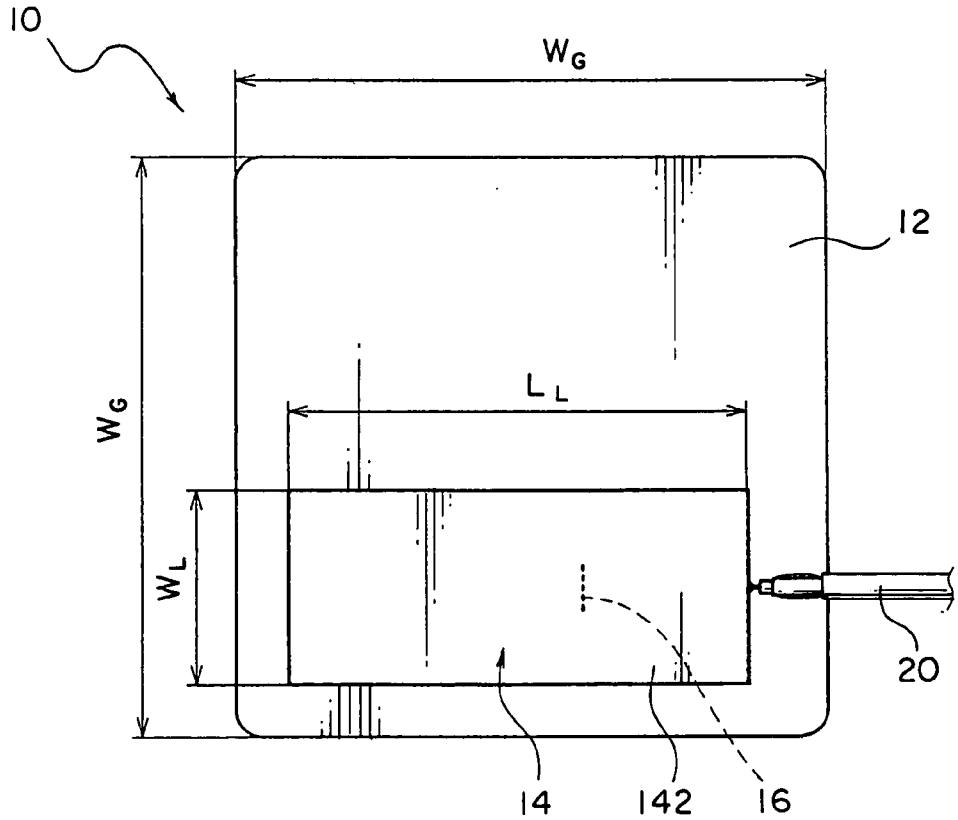
FIG. 2 PRIOR ART
FIG. 2 is a plan view of the antenna apparatus illustrated in FIG. 1.
Figure 3:
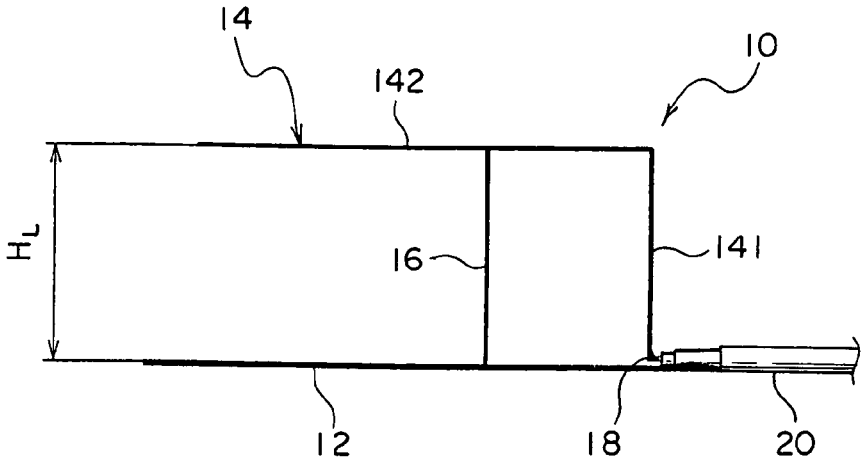
FIG. 3 PRIOR ART
FIG. 3 is a front view of the antenna apparatus illustrated in FIG. 1.
Figure 4:
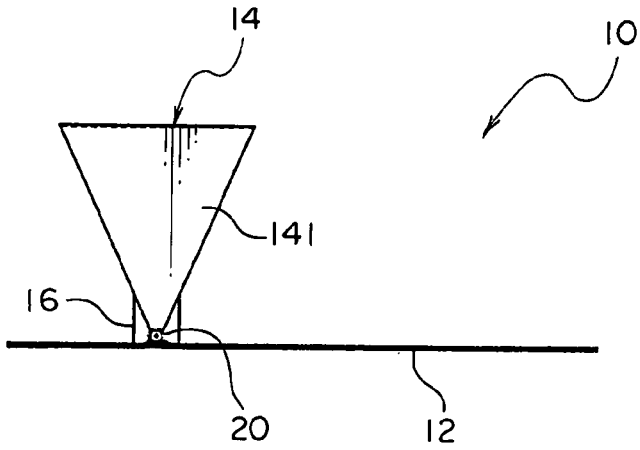
FIG. 4 PRIOR ART
FIG. 4 is a right side view of the antenna apparatus illustrated in FIG. 1.

As will be described later, the inverse F-type antenna apparatus 10A has the same constitution as the inverse F-type antenna apparatus 10 shown in FIG. 1 except that the inverse F-element has a different constitution. Therefore, the members having the same functions as those of the inverse F-type antenna apparatus 10 illustrated in FIGS. 1 to 4 are denoted by the same reference numerals.

The inverse F-type antenna apparatus 10A includes a grounding conductor 12, an L-shaped radiating conductor 14A, and a vertical conductor (short-circuiting conductor) 16A.

In detail, the grounding conductor 12 is of a square shape having a side of a length $W_G$. In the illustrated embodiment, the grounding conductor 12 has a length $W_G$ of 90 mm.

The radiating conductor 14A includes a vertical portion 141A extending vertically from a feeding point 18 provided maintaining a very narrow gap to the grounding conductor 12, and a horizontal portion 142 extending in parallel with the grounding conductor 12 from an end (upper end) of the vertical portion 141A. The vertical portion 141A has a meandering shape (i.e., folded shape) of an inverse isosceles triangle with the feeding point 18 as a vertex. The sides of the inverse isosceles triangle opposing the vertex are forming the end (upper end) of the vertical portion 141A. The horizontal portion 142 is of a rectangular shape having a length $L_L$ and a width $W_L$. In the illustrated embodiment, the horizontal portion 142 has a length $L_L$ of 69.75 mm and a width $W_L$ of 30 mm. An end of the horizontal portion 142 is connected to the end (upper end) of the vertical portion 141A, and the other end of the horizontal portion 142 is opened. The length from the feeding point 18 of the radiating conductor 14A to the open end is selected to possess an electric length of about one-fourth the radiation wavelength.

The vertical conductor (short-circuiting conductor) 16A has a rectangular shape and is located at a position slightly separated from the vertical portion 141A. The vertical conductor 16A is vertically extending in parallel with the vertical portion 141A of the radiating conductor 14A from the grounding conductor 12 to the horizontal portion 142 of the radiating conductor 14A. One end of the vertical conductor 16A is connected to the grounding conductor 12, and the other end of the vertical conductor 16A is connected to the horizontal portion 142 of the radiating conductor 14A. In the illustrated embodiment, the vertical conductor 16A has a height $H'_L$ of 24 mm. The height $H'_L$ of the vertical conductor 16A is nearly equal to the height of the inverse F-type antenna apparatus 10A.

The center conductor of the coaxial cable 20 is electrically connected to the feeding point 18, and the outer conductor of the coaxial cable 20 is electrically connected to the grounding conductor 12.

The vertical portion 141A of the radiating conductor 14A includes a lower portion 141A-1 upwardly extending from the feeding point 18, an upper portion 141A-2 downwardly extending from the upper end of the vertical portion 141A, and an intermediate portion 141A-3 of nearly a U-shape in cross section between the lower portion 141A-1 and the upper portion 141A-2. The intermediate portion 141A-3 is of a shape dented toward the vertical conductor 16A. In the illustrated embodiment, the lower portion 141A-1 has a height (length) $H_1$ of 10 mm and the upper portion 141A-2 has a height (length) $H_2$ of 6.5 mm. On the other hand, the intermediate portion 141A-3 has a depth D of 4.75 mm.

In the inverse F-type antenna apparatus 10A of this invention as described above, the vertical portion (rising portion) 141A of the radiating conductor 14A is formed in a meandering shape to lengthen the effective electric length in the direction of height. This makes it possible to decrease the height $H'_L$ of the inverse F-type antenna apparatus 10A to be smaller than that of the conventional inverse F-type antenna apparatus 10 and, hence, to lower the height while maintaining the desired antenna characteristics such as a radiation pattern characteristic.

Though this invention was described above by way of a preferred embodiment, this invention is in no way limited to the above embodiment only. In the above embodiment, for example, the vertical portion of the radiating conductor is formed in a meandering shape denting toward the vertical conductor. However, the vertical portion of the radiating conductor may be formed in a meandering shape that is dented toward the side opposite to the vertical conductor.

To increase the electric length in the direction of height in this invention, the vertical portion (rising portion) is formed in a meandering shape to obtain increased effective electric length. This makes it possible to decrease the height of the inverse F-type antenna apparatus to be smaller than that of the conventional inverse F-type antenna apparatus and, hence, to decrease the height while maintaining desired antenna characteristics.

What is claimed is:

1. An antenna apparatus comprising:

a grounding conductor; and an inverse F-element provided on said grounding conductor;

wherein said inverse F-element comprises:

an L-shaped radiating conductor comprising a vertical portion vertically extending from a feeding point provided with a gap with respect to said grounding conductor, and a horizontal portion extending in parallel with said grounding conductor from an upper end of said vertical portion; and a short-circuiting conductor which extends vertically from said grounding conductor to the horizontal portion of said radiating conductor and in parallel with the vertical portion of said radiating conductor at a position separated from said vertical portion;

wherein the vertical portion of said radiating conductor has a meandering shape and has a shape of an inverse isosceles triangle with a vertex at the feeding point.

2. An antenna apparatus according to claim 1, wherein the vertical portion of said radiating conductor includes a lower portion upwardly extending from said feeding point, an upper portion downwardly extending from said upper end, and an intermediate portion folded between said lower portion and said upper portion.

3. An antenna apparatus according to claim 2, wherein said intermediate portion has a shape that is bent one of: toward said short-circuiting conductor, and away from said short-circuiting conductor.

4. An antenna apparatus according to claim 1, wherein the horizontal portion of said radiating conductor has a rectangular shape.

5. An antenna apparatus according to claim 2, wherein the horizontal portion of said radiating conductor has a rectangular shape.

6. An antenna apparatus according to claim 3, wherein the horizontal portion of said radiating conductor has a rectangular shape.

* * * * *